US005522326A

United States Patent [19]

Vollhardt

[11] Patent Number: 5,522,326

[45] Date of Patent: Jun. 4, 1996

[54] DEVICE FOR REMOVING TOXIC SOLID AND/OR LIQUID SUBSTANCES FROM PROJECTILES FILLED WITH CHEMICAL WARFARE AGENTS

[75] Inventor: Frohmut Vollhardt, Oberhausen, Germany

[73] Assignee: MAN Gutehoffnungshütte Aktiengesellschaft, Oberhausen, Germany

[21] Appl. No.: 316,570

[22] Filed: Sep. 30, 1994

[30] Foreign Application Priority Data

Oct. 4, 1993 [DE] Germany ..... 43 33 780.5

[51] Int. Cl.[6] ..... F23B 5/00

[52] U.S. Cl. ..... 110/211; 110/215; 110/234; 110/237; 110/246

[58] Field of Search ..... 110/237, 246, 110/234, 212, 215, 211

[56] References Cited

U.S. PATENT DOCUMENTS 4,934,283 6/1990 Kydd ..... 110/237 X 4,976,210 12/1990 Dewald ..... 110/246

5,393,501 2/1995 Clawson et al. ..... 110/246 X

OTHER PUBLICATIONS

Frohmut Vollhardt, Anlagen zur Sondermüllverbrennung, Chem–Ing.–Tech. 59, 1987, pp. 622–628.

*Primary Examiner*—Henry A. Bennett
*Assistant Examiner*—Susanne C. Tinker
*Attorney, Agent, or Firm*—McGlew and Tuttle

[57] ABSTRACT

A device for incinerating solid and/or liquid toxic substances, especially projectiles filled with chemical warfare agents. Because the ammunition to be incinerated may have been inadvertently not disarmed the incinerator plant must be able to withstand an operating pressure of at least 40 bar. The incineration includes a rotatably mounted unit consisting of a rotary tubular kiln, an afterburning chamber, and a waste heat boiler. The unit is designed in a corresponding pressure-proof manner, and the rotary tubular kiln as well as the afterburning chamber are lined with refractory material. The operating pressure is generated by a compressor arranged upstream of the incinerator plant, and it is released by an expander arranged downstream of the entire plant.

5 Claims, 2 Drawing Sheets

DEVICE FOR REMOVING TOXIC SOLID AND/OR LIQUID SUBSTANCES FROM PROJECTILES FILLED WITH CHEMICAL WARFARE AGENTS

FIELD OF THE INVENTION

The present invention pertains to a device for disposing of solid and/or liquid toxic substances, especially projectiles filled with chemical warfare agents, in a special waste incinerator plant including a rotary tubular kiln, an afterburning chamber, a waste heat boiler, a flue gas scrubber, an induced draft ventilator, and a waste gas flue.

BACKGROUND OF THE INVENTION

Special waste incinerator plants for incinerating liquid and/or solid toxic substances have been known from, e.g., the German journal *Chemie-Ingenieur-Technik*, Vol. 59 (1987), No. 8, pp. 622–628.

The projectiles and other ammunition left over from the two world wars, which are filled with chemical warfare agents, represent a special type of special waste.

These chemical warfare agents may be solid and/or liquid toxic substances of a great variety of chemical compositions, or they may also be gaseous.

The chemical warfare agents continue to be in non-disarmed projectiles, i.e., the percussion, proximity or time fuses must be disarmed before any disposal.

The projectiles filled with chemical warfare agents may be stored in any type of container, or they may be disposed of as a pile in filled-up bodies of water, mines, or even at sea.

In the case of intensified corrosion, caused by moisture in the ground or seawater, there is a risk that the containers and the projectiles are or become leaky. As a result, the chemical and toxic substances come into direct contact with their immediate environment, i.e., the ground surrounding them, groundwater or seawater. These circumstances lead to the contamination of large areas.

The destruction of the large amounts of warfare agents still present has not been intensely pursued so far, because the selected storage was thought to be sufficiently safe for decades, and, e.g., the disposal of the warfare agents at sea was thought to solve the problem.

However, investigations conducted at such storage sites revealed that the containers in which the projectiles are stored have partially decayed, and further storage is no longer acceptable for reasons of environmental protection, so that the disposal of the chemical warfare agents is absolutely necessary.

SUMMARY AND OBJECTS OF THE INVENTION

The object of the present invention is to provide a device with which the disarmed projectiles can be disposed of in an environmentally acceptable manner, but the fact that non-disarmed projectiles may accidentally also be delivered for disposal must be taken into account.

According to the invention, a device for disposing of solid and/or liquid toxic substances, particularly projectiles filled with chemical warfare agents is provided in the form of a special waste incinerator plant. The plant includes a rotary tubular kiln, an afterburning chamber, a waste heat boiler, a flue gas scrubber, an induced draft ventilator and a waste gas flue. The rotary tubular furnace, the afterburner chamber and the waste heat boiler are designed as a rotatable unit. The unit is designed such that it withstands an internal pressure of 40 bar. A pressure lock is provided with a feeding device integrated in it and a compressor is provided for generating the necessary operating pressure. The pressure lock and the compressor are arranged upstream of the rotary tubular kiln. A sealing system is provided arranged between the rotatable waste heat boiler and the stationary flue gas collection tank.

A slide collection chamber is arranged in the transition area between the rotary tubular kiln and the afterburning chamber. The waste heat boiler has a co-rotating steam entrainment means connected to the housing wall. A stationary steam exhaust means is arranged centrally with respect to an axial direction. The feed water feed and the steam feed lines are led through a sealing system at the flue gas collection tank and communicate with the waste heat boiler. An expander and a flue gas scrubber are arranged downstream of the outlet pipe connection of the flue gas collection tank.

To dispose of the projectiles, which are usually disarmed and whose casing was made of steel, brass, aluminum, plastics or other materials, and in which toxic chemical substances are contained, a special waste incinerator plant of the type described in the introductory part is proposed, which is characterized in that the components of the high-temperature incineration part and of the cooling and purification stages following it are constructed, in terms of design and the materials used, for minimum operating pressure of 40 bar, and that the necessary sealing of the rotating part of the plant against the atmosphere is guaranteed.

The parts of the plant must withstand an operating pressure of 40 bar, because non-disarmed projectiles and highly explosive substances, which may explode in the rotary tubular kiln or in the afterburning chamber during the incineration at temperatures of up to and exceeding 1,200° C., and generate a correspondingly high blast wave within the entire system, may also be charged into the rotary tubular kiln.

Because of such blast waves, the rotating parts of the plant must be constructed, in terms of the materials to be used and their design, for pressures of at least 40 bar, and it must be borne in mind that the actual pressure may be slightly lower or slightly higher than the pressure indicated, depending on the type of the ammunition to be destroyed. The plant parts should therefore be dimensioned correspondingly.

This is achieved by designing the high-temperature incineration part and the cooling and purification part as an integrated, rotating device.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
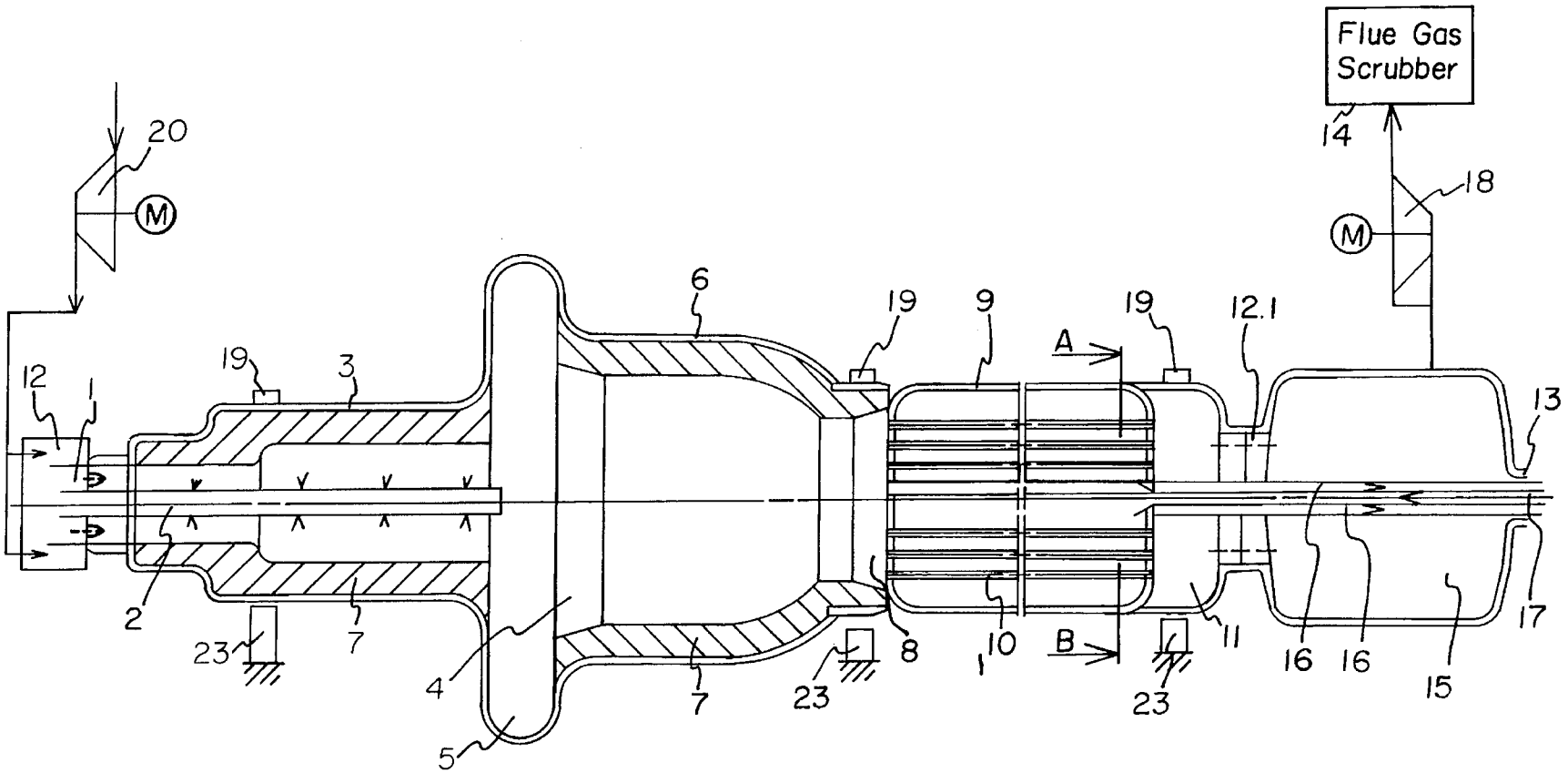
FIG. 1 is a longitudinal section through the incinerator plant.

The incinerator plant represented in FIG. 1 is composed of the rotatable unit 3, 6, 9 and 11, which is rotatably mounted on roller bearings 23 and in running rings 19, and of the stationary plant parts, which are located upstream and downstream of the rotatable unit 3, 6, 9 and 11 and are sealed by sealing systems on both sides, namely a pressure lock 12 and sealing system means 12.1.

The rotatable unit designed for an operating pressure of at least 40 bar includes the rotary tubular kiln 3, the afterburning chamber 6, and the waste heat boiler 9.

This plant must be designed for high operating pressures for safety's sake, because warfare ammunition not disarmed in advance may also be expected to be accidentally charged into the rotary tubular kiln.

The non-incinerated metallic parts of the ammunition are collected in the slag collection chamber 5 arranged between the rotary tubular kiln 3 and the afterburning chamber 6. These remnants can be removed via a removal opening after the plant operations have been stopped.

The rotary tubular kiln 3 and the afterburning chamber 6 are lined with a refractory and abrasion-resistant lining 7. The slag collection chamber 5 may be spray-coated with a refractory composition if needed.

The flue gases are cooled in the rotatable waste heat boiler 9. The hot flue gases flow through cooling tubes 10 and release their heat to the feed water fed in via a feed line 17.

The water-steam mixture leaves the waste heat boiler 9 via the steam discharge lines 16 arranged centrally around the feed water feed line 17.

The cooled flue gas, which is, however, still under a high operating pressure, is collected in a stationary flue gas collection tank 15 before it is fed into an expander 18 with the flue gas scrubber 14 arranged downstream of it.

The flue gas collection tank 15 is sealed against the atmosphere by a sealing system 13 in the area of the pipelines 16, 17.

The pressure lock 12 in the form of a double chamber, within which the charging device 1 for the ammunition to be incinerated is integrated, is arranged on the charging side of the rotary tubular kiln 3.

The rotary tubular kiln 3 is heated by a lance-like gas or oil-oxygen burner 2. Burners (not shown here) are also arranged on the afterburning chamber 6.

A compressor 20, which is connected to the pressure lock 12 via high-pressure lines, is provided for generating the necessary operating pressure of at least 40 bar.

Figure 2:
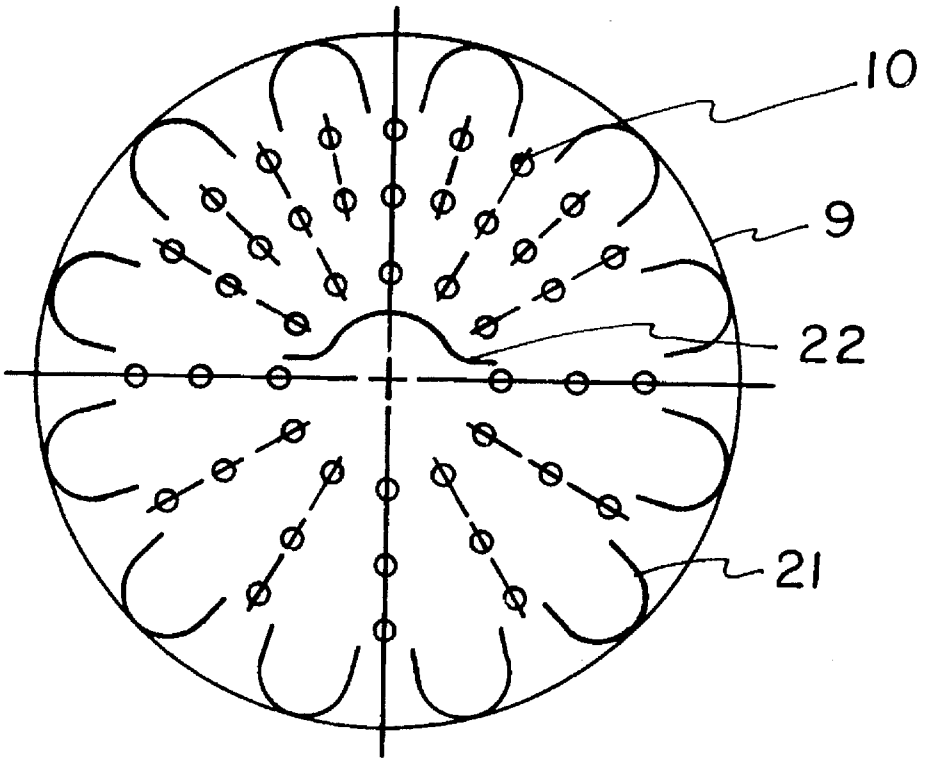
FIG. 2 is a cross section corresponding to A–B according to FIG. 1.

In a cross section corresponding to the intersection line A–B in FIG. 1, FIG. 2 shows the interior of the waste heat boiler 9. The cooling tubes 10, the steam entrainment means 21, and the stationary steam exhaust means 22 in the center of the waste heat boiler 9 are seen. This arrangement is necessary for collecting the steam rising upward within the rotating waste heat boiler 9 and for drawing it off via the steam exhaust means 22 and the steam discharge lines 16.

While a specific embodiment of the invention has been shown and described in detail to illustrate the application of the principles of the invention, it will be understood that the invention may be embodied otherwise without departing from such principles.

What is claimed is:

1. Device for disposing of toxic substances including projectiles filled with chemical warfare agents, comprising:

a rotary tubular kiln;

an afterburner chamber;

a waste heat boiler, said rotary tubular kiln, said afterburning chamber and said waste heat boiler forming a rotatable unit, said rotatable unit being designed to withstand an internal pressure of 40 bar;

a stationary flue gas collection tank;

sealing system means connected between said stationary flue gas collection tank and said rotatable unit for sealing between said rotatable unit and said stationary flue gas collection tank;

a pressure lock with an integrated feeding device and a compressor for generating operating pressure within said rotatable device, said pressure lock and said compressor being arranged upstream of said rotatable unit, connected thereto.

2. Device according to claim 1, further comprising a slag collection chamber forming a part of said rotatable unit, said slag collection chamber being arranged in a transition area between said rotary tubular kiln and said afterburning chamber.

3. Device according to claim 1, wherein said waste heat boiler includes steam entrainment means rotating with said waste heat boiler, said steam entrainment means for collecting steam within said rotating waste heat boiler, said steam entrainment means being connected to a housing wall of said waste heat boiler; and stationary steam exhaust means arranged axially centrally within said waste heat boiler for exhausting steam from within said waste heat boiler.

4. Device according to claim 1, further comprising sealing system means at said flue gas collection tank for sealing feed water feed and steam feed lines, said feed water feed and said steam feed lines communicating with said waste heat boiler.

5. Device according to claim 1, further comprising an expander connected downstream of said flue gas collection tank.

* * * * *